US007457757B1

(12) United States Patent
McNeill et al.

(10) Patent No.: US 7,457,757 B1
(45) Date of Patent: Nov. 25, 2008

(54) INTELLIGIBILITY CONTROL FOR SPEECH COMMUNICATIONS SYSTEMS

(75) Inventors: Iain McNeill, Aptos, CA (US); Robert M. Khamashta, Los Gatos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 770 days.

(21) Appl. No.: 10/159,240

(22) Filed: May 30, 2002

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS 4,061,875 A * 12/1977 Freifeld et al. ..... 381/72
4,099,035 A * 7/1978 Yanick ..... 381/320
5,600,714 A * 2/1997 Eppler et al. ..... 379/406.08
5,727,068 A * 3/1998 Karagosian et al. ..... 381/22
5,794,187 A * 8/1998 Franklin et al. ..... 704/225
6,597,301 B2 * 7/2003 Cerra ..... 341/155

* cited by examiner

*Primary Examiner*—Susan McFadden

(57) ABSTRACT

A method of enhancing the intelligibility of speech sounds in a communications headset, includes: detecting an incoming signal with speech content; based upon detectable parameters in the incoming signal, determining a combination of signal processing parameters including a high pass cutoff frequency value and a low pass cutoff frequency value for a filtering function, and an expander threshold level, an expander attack time, and an expander release time for an expander function; and sequentially applying the filtering function and expander function to the incoming signal so that the degraded sound quality of the incoming signal may be modified real-time to increase intelligibility as variations occur in speech sound quality of the incoming signal.

46 Claims, 9 Drawing Sheets

User selectable configurations of analog signal processors

Algorithm flowchart to enhance intelligibility using DSP

INTELLIGIBILITY CONTROL FOR SPEECH COMMUNICATIONS SYSTEMS

TECHNICAL FIELD

This disclosure relates generally to the field of audio signal processing, and more particularly to the field of intelligibility enhancing processes using non-linear amplitude and frequency modifying modules.

BACKGROUND

Modern telephones allow for the connection of a multitude of devices ranging from traditional wired, analog telephones to cordless telephones and digital cellular phones and even Internet connected audio communication devices. The deregulation of the telephone companies has resulted in a general relaxation of the performance specifications and interface specifications. In fact, customers have disadvantageously accepted a significant degradation in the sound quality of telephone communications in exchange for convenience and mobility. This has made the task of designing a telephone headset adapter that gives the best perceived sound quality in all situations exceedingly difficult. What sounds most natural and clear in a quiet environment using traditional wired telephones does not provide the most intelligible speech when the far-end caller is in a fast moving car on a cellphone. Similarly, an adapter design that is optimized to provide the most effective communication in a noisy office will perform poorly in a competitive comparison with a simple, linear headset amplifier in a quiet, acoustically treated room.

Traditionally, telephone headset adapter systems were designed to perform well in noisy and/or distorted conditions. The audio bandwidth was limited to only those frequencies essential for speech, and non-linear processing techniques, such as gain switching or expansions, were used to provide some degree of background noise cancellation. However, as the competitive landscape expands, customers have more choices of products, and with the sound quality improvement of digital communications, they are choosing products that provide more natural sounds. Most headset users are unaware of the intelligibility benefits of bandwidth limiting and non-linear processing in adverse environments and rather see these attributes as negative. When confronted with a poor quality call, the user typically only has access to a volume control and, therefore, has to increase the loudness and/or ask callers to repeat themselves until the user can understand a caller. For a call center company, a poor quality call may result in lost revenue for the company because the call center agent may be required to ask the caller to repeat himself or herself. This resulting delay can prevent the call center agent from accepting calls from other callers, and this can negatively impact the revenue stream of the company.

Recent adapter systems have provided a tone control to allow the user to adjust the tonal quality of the sound. While this allows the user to "tune" the sound to the caller's voice and the user's personal preference, this feature does little to improve intelligibility by improving the signal to noise ratio. This feature is more like a selective loudness control, by making some part of the speech spectrum louder in an attempt to permit the user to understand the caller.

Some current voice expander circuits are useful in improving the signal to noise ratio, but their performance is increasingly compromised by the relaxing telephony standards which give rise to greatly varying signal levels and spectra depending on the source of the call. The expander threshold for these circuits can not be set to a fixed level for all types of call.

Therefore, the current technologies are limited to particular capabilities and suffer from various constraints.

SUMMARY OF EMBODIMENTS OF THE INVENTION

In accordance with an embodiment of the invention, a method of enhancing the intelligibility of speech sounds in a communications headset, includes: detecting an incoming signal with speech content; based upon detectable parameters in the incoming signal, determining a combination of signal processing parameters including a high pass cutoff frequency value and a low pass cutoff frequency value for a filtering function, and an expander threshold level, an expander attack time, and an expander release time for an expander function; and sequentially applying the filtering function and expander function to the incoming signal so that the degraded sound quality of the incoming signal may be modified real-time to increase intelligibility as variations occur in speech sound quality of the incoming signal.

The set of signal processing configuration parameters may further include a compressor threshold level, a compressor attack time, and a compressor release time for a compressor function. The method may further include, sequentially applying the compressor function to the incoming signal.

The set of signal processing configuration parameters may further include a center frequency value and pass band contour for a pass band contour function. The method may further include, sequentially applying the pass band contour function to the incoming signal.

In another embodiment, an apparatus for enhancing the intelligibility of speech sounds in a communications headset, includes: a detector configured to detect an incoming signal with speech content; a signal processing stage coupled to the detector, the signal processing stage comprising a filter stage configured to provide a filtering function to the incoming signal and an expander stage configured to provide an expander function to the incoming signal, where the filtering function and expander function are sequentially applied to the incoming signal so that the degraded sound quality of the incoming signal may be modified real-time to increase intelligibility as variations occur in speech sound quality of the incoming signal; and a microcontroller configured to determine a combination of signal processing parameters including a high pass cutoff frequency value and a low pass cutoff frequency value for the filtering function, and an expander threshold level, an expander attack time, and an expander release time for the expander function, based upon detectable parameters in the incoming signal.

An embodiment of the invention may be implemented in the analog domain and/or digital domain.

These and other features of an embodiment of the present invention will be readily apparent to persons of ordinary skill in the art upon reading the entirety of this disclosure, which includes the accompanying drawings and claims.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF PREFERRED EMBODIMENTS

In the description herein, numerous specific details are provided, such as examples of components and/or methods, to provide a thorough understanding of embodiments of the invention. One skilled in the relevant art will recognize, however, that an embodiment of the invention can be practiced without one or more of the specific details, or with other apparatus, systems, methods, components, materials, parts, and/or the like. In other instances, well-known structures, materials, or operations are not shown or described in detail to avoid obscuring aspects of embodiments the invention.

The invention creates value by enhancing communications. An embodiment of the invention advantageously provides the user the capability to use known signal processing techniques in a unique and appropriate fashion without adding complexity and a need to understand the parameters that are processed. Embodiments of the invention may allow the user to hear the best quality audio that modern telephony has to offer when the call quality is good and yet may provide intelligibility benefits when the call quality is poor.

Very few headset users possess the equipment or knowledge to correctly set the bandwidth, frequency response, expander threshold, depth, attack time, and/or release time for a specific call. An embodiment of the invention advantageously provides an "intelligibility control" that provides the user with a selection of configurations and/or signal processing parameters that can be quickly adjusted in real-time and optimized for different telephony environments.

Figure 1:
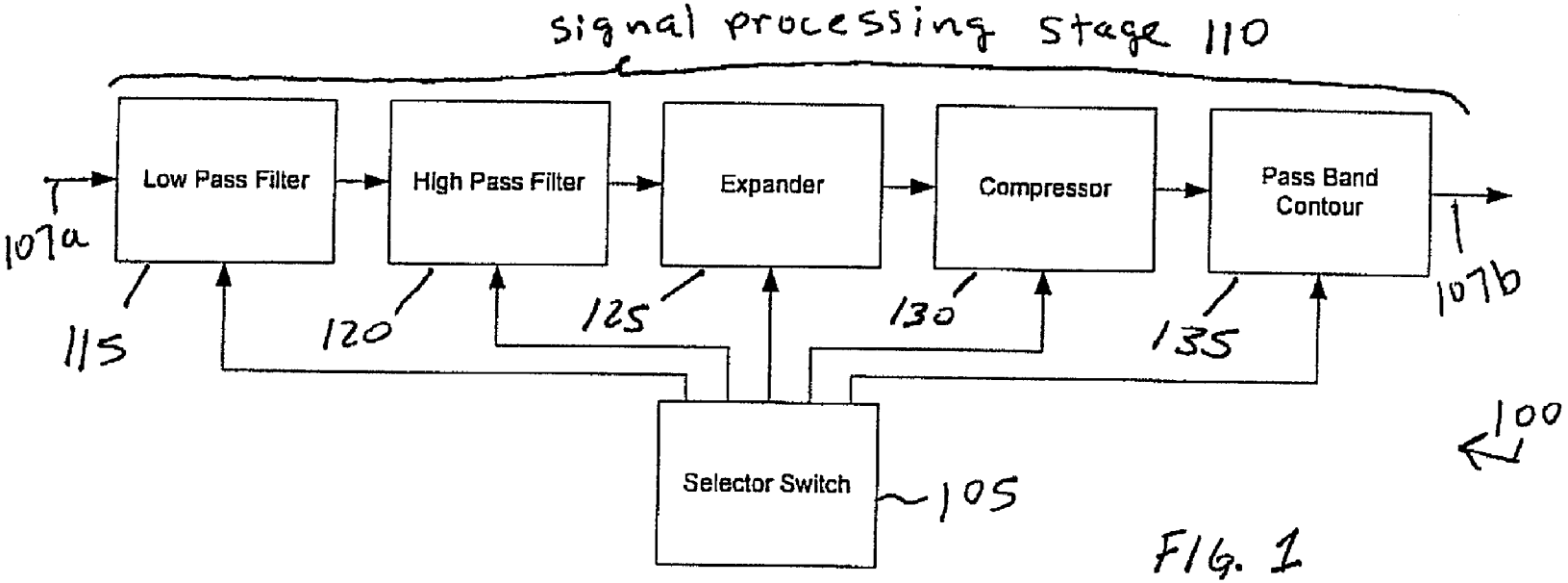
FIG. 1 is a block diagram of an apparatus in accordance with an embodiment of the invention.

FIG. 1 is a block diagram of an apparatus 100 in accordance with an embodiment of the invention. The apparatus 100 includes a selector switch 105 coupled to a signal processing stage 110. The selector switch 105 permits a user to manually choose one of a number of predetermined configurations of the signal processing stage 110 so that the speech sound quality of an incoming signal 107*a* is improved. The signal processing stage 110 modifies the incoming signal 107*a* to produce an output signal 107*b* with improved intelligibility for the speech sounds. The incoming signal 107*a* is typically the sound that the user may initially hear from, for example, a telephone network (such as a Plain Old Telephone Service or POTS network), a cellular phone network, a voice-over-Internet-Protocol system, or other systems where artifacts, noise, or distortions may affect the intelligibility of the speech sounds in the incoming signal 107*a*. Thus, the signal processing stage 110 may modify the natural sound quality of the incoming signal 107*a* to produce an output signal 107*b* with improved intelligibility for the speech sounds. Therefore, in an embodiment, when the user picks up the call, he/she would initially hear the full band audio. The user can use the selector switch 105 to control the signal processing stage 110 to modify the incoming signal 107*a* so that the caller's voice would step out from the noise.

The selector switch 105 may be, for example, a standard rotary switch that can be set or it may be actuated by pressing buttons or other types of selection mechanisms. Thus, when the user picks up a call and first hears an adverse (e.g., noisy) call environment, he/she could manually try different configurations (or sets of configuration parameters) until the best intelligibility can be heard. In other words, the user can select configurations that are optimized based upon the telephony environment of the caller. Discussed below are example sets of predetermined signal processing configuration parameters that are used in response to the particular sound conditions in the caller's environment or telephony environment so that the speech sounds are made more intelligible.

In one embodiment, the signal processing stage 110 includes a low pass filter 115, high pass filter 120, expander 125, compressor 130, and pass band contour 135. Further, these elements within the signal processing stage 110 can be combined in multiples to enhance processing control. For example, one could use 2 expanders in element 125. These expanders may be identical or very different in their respective non-linear parameters or thresholds. Additionally or alternatively, in an embodiment of the invention, the compressor 130 and/or the pass band contour stage 135 may be omitted in the signal processing stage 110. Other suitable arrangements or configuration of elements are possible within the signal processing stage 110.

The low pass filter 115 can set the high pass cutoff frequency and the high pass filter 120 can set the low pass cutoff frequency. Thus, the filters 115 and 120 can be used to control the bandwidth (frequency span) of the apparatus 100. As an example, the bandwidth of a telephone channel is theoretically between approximately 330 Hertz to 3.3 kilo-Hertz. However, if the transmission medium for the signal is a short analog line, then the high pass cutoff frequency may exceed 3.3 kHz, where the cutoff frequency is defined as the filter's −3 dB point. For a digital line, the bandwidth may be, for example, between approximately 100 Hz to 4.0 kHz. As another example, voice-over-Internet-Protocol applications may potentially increase the high pass cutoff frequency to approximately 7.0 kHz.

By increasing the bandwidth, more ambient noise may not be filtered by filters 110 and 115, and this noise might be amplified and make the speech content less than intelligible. For example, air conditioning noise is typically below approximately 150 Hz, while wind noise heard in a moving car may be between approximately 400 Hz to 500 Hz. The ability to adjust the bandwidth is very useful in making the speech content in an incoming signal 107*a* more intelligible. For example, the bandwidth may be adaptively narrowed to the frequency range where there is little ambient noise, and this narrowing of the frequency range may maximize the signal to noise ratio of the incoming signal.

Figure 2:
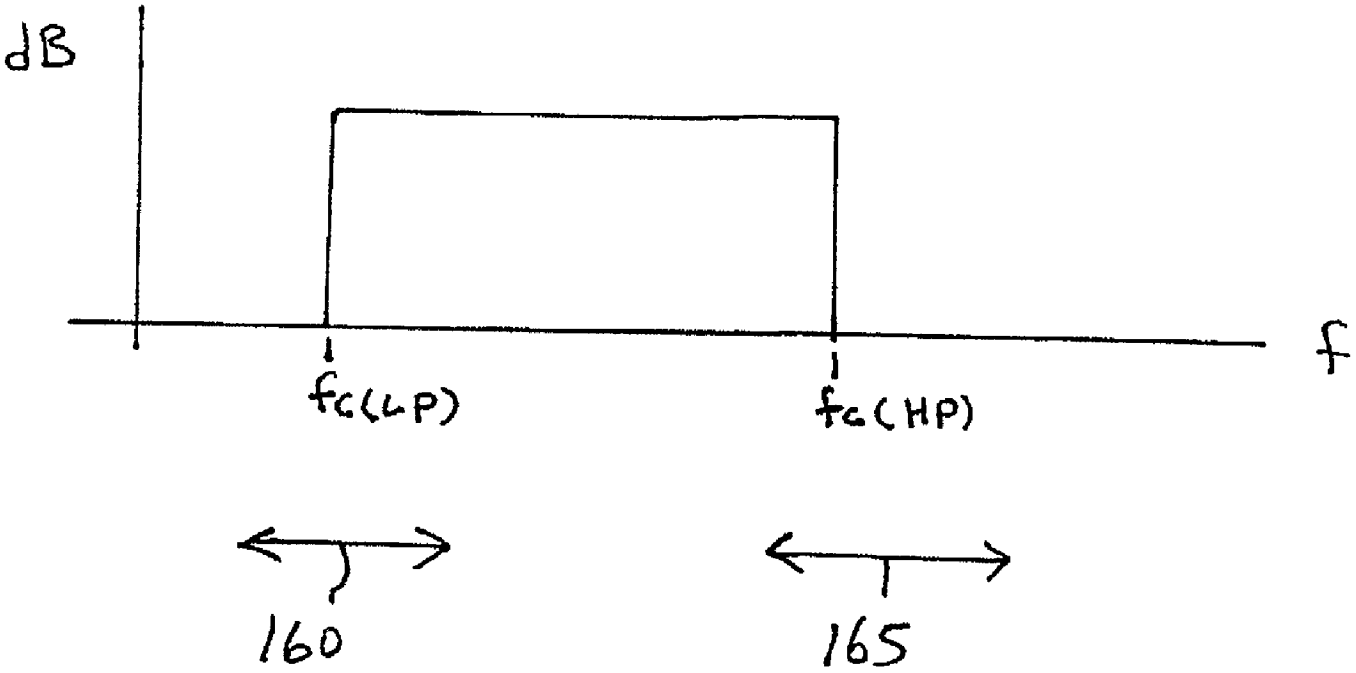
FIG. 2 is a waveform diagram showing the adjustable parameters for the bandwidth of an apparatus according to an embodiment of the invention.

As shown in FIG. 2, in one embodiment, the selector switch 105 may be used by the user to adjust (160) the cutoff frequency ("$f_{C(LP)}$") of the low pass filter 115 and to adjust (165) the cutoff frequency ("$f_{C(HP)}$") of the high pass filter 120. Thus, the bandwidth of the apparatus 110 can be narrowed or widened, depending on the quality of the incoming signal 107*a*. By adjusting the bandwidth, the intelligibility of the speech sounds in the incoming signal 107*a* may be improved.

It is apparent to one skilled in the art that a controllable filter can be implemented in many ways. For instance a filter block built from an op-amp using capacitors to define cut off frequencies can be controlled by switching in different combinations of capacitor value. Alternatively, a switched capacitor filter can be adjusted by varying the clock frequency. These can both be configured to provide a few number of widely separated cut off frequencies or a large number of closely spaced frequencies depending on the complexity of the circuit and the required resolution of adjustment.

In the embodiment shown in FIG. 1, the selector switch 105 may also be used to control the settings for the expander 125, compressor 130, and pass band contour 135.

Figure 3:
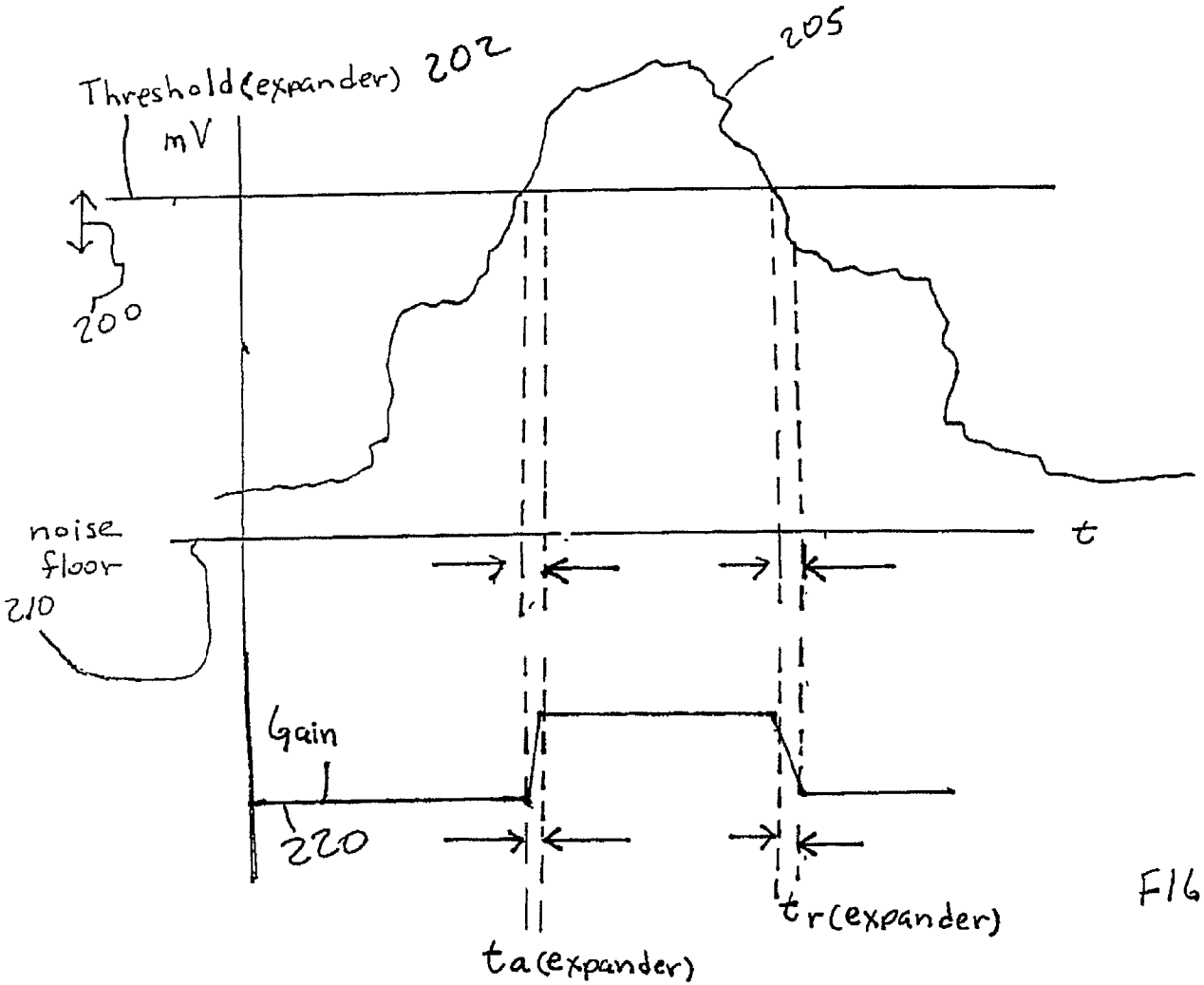
FIG. 3 is a waveform diagram illustrating the adjustable parameters for an expander in an apparatus according to an embodiment of the invention.

The expander parameters that can be set by the selector switch 105 include, for example, the expander threshold ("$\text{Threshold}_{(expander)}$"), expander attack time ("$t_{a(expander)}$"), and expander release time ("$t_{r(expander)}$"), as shown in FIG. 3. Typically, expanders are used for noise reduction. The expander threshold is set at a level below the average level of the speech sound, but above the noise floor, so that when the speech stops, the gain provided by the expander 125 drops down. The noise floor is the amount of noise present in the incoming signal 107*a* due to the transmission channel equipment, interference from other channels and equipment, as well as far end ambient and system noise. The noise floor is measured in decibels and can be measured by detecting the amplitude of the incoming signal when there are no speech utterances. Minimizing the noise floor leads to expanded dynamic range and cleaner sound production. As an example, an expander might be set up with a 1:6 ratio. This means that for every 1 dB of input level change the expander sees, it will output a 6 dB change. When a signal drops below the threshold by 2 dB, the output of the expander will drop by 12 dB, similarly dropping the level of any background noise floor.

Referring now to FIG. 3, the expander threshold ($\text{Threshold}_{(expander)}$) can be adjusted (200) by increasing or decreasing the expander threshold level. The gain 220 applied to the incoming signal 107*a* is increased if the speech envelope 205 is detected. This adjustment can add intelligibility to speech sounds in the incoming signals. Typically, the expander threshold level is set between the noise floor 210 and the average level (rms) of the speech envelope 205.

The expander attack time ($t_{a(expander)}$) is the speed by which the gain 220 is increased from nominal after the speech envelope 205 has exceeded the threshold 202. A shorter attack time will allow a higher threshold to be implemented without cutting off the beginning of the utterance. The expander attack time may be increased or decreased to add intelligibility to speech sounds.

The expander release time ($t_{r(expander)}$) is the speed by which the gain 220 is decreased after the speech envelope 205 falls below the threshold 202. A shorter release time will increase the speed by which background noise is attenuated after the end of the speech utterance. The expander release time may be increased or decreased to add intelligibility to speech sounds. In a high noise environment, the expander attack time and release time is typically decreased (shortened) so that noise is not modulated at the beginning and/or at the end of a speech utterance.

A compressor is a device that can reduce the dynamic range of an audio signal. The dynamic range is the ratio of the loudest (undistorted) signal to that of the quietest (discernible) signal in a unit or system as expressed in decibels (dB), and is another way of stating the maximum signal to noise ratio. When the incoming signal is louder than the compressor threshold, its gain is reduced. The amount of gain reduction applied depends on the compression ratio setting. For example, with a 2:1 ratio, for every 2 decibels the input signal increases, the output is allowed to increase only 1 decibel.

Figure 4:
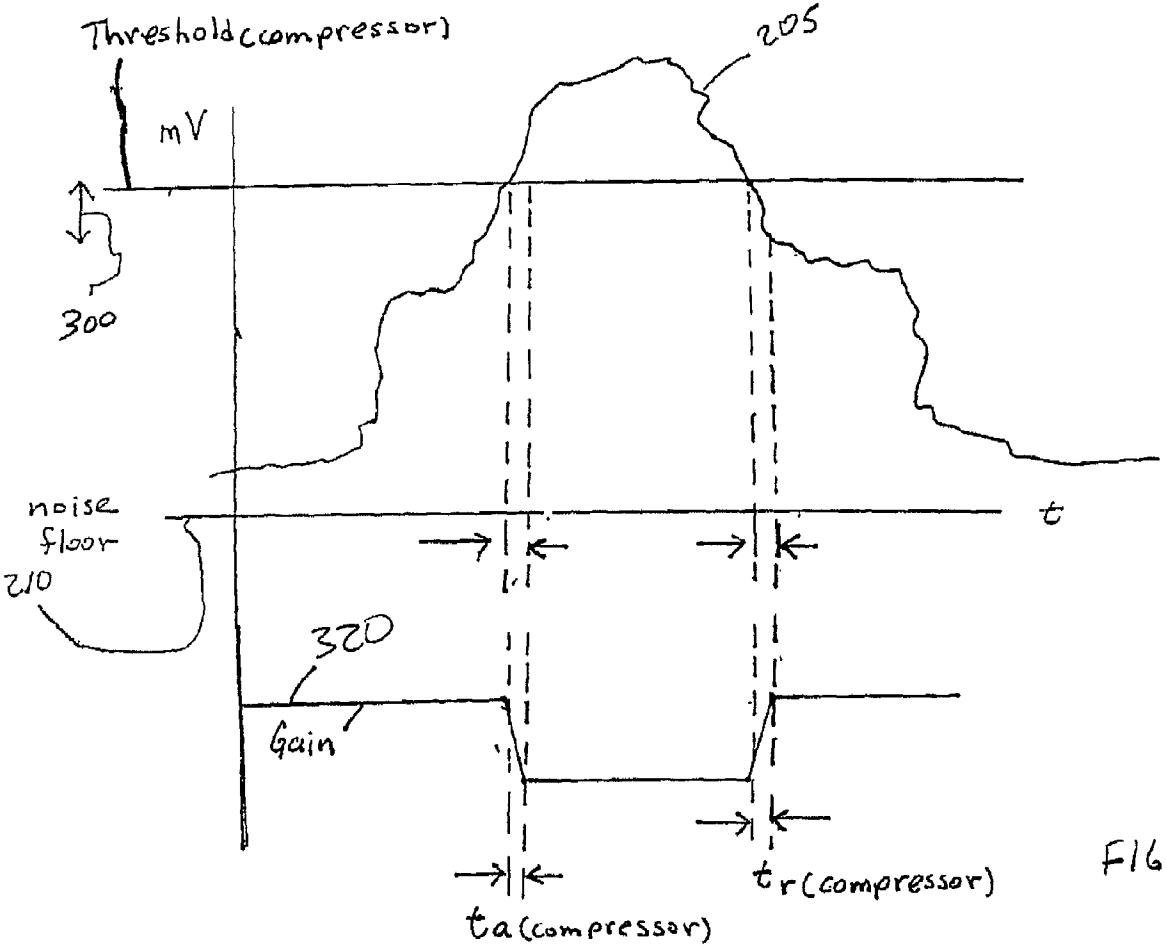
FIG. 4 is a frequency response diagram illustrating the adjustable parameters for a compressor in an apparatus according to an embodiment of the invention.

Referring now to FIG. 4, the compressor threshold level ($\text{Threshold}_{(compressor)}$) can be adjusted (300) by increasing or decreasing the threshold level. This adjustment can add intelligibility to speech sounds in the incoming signals.

The compressor attack time ($t_{a(compressor)}$) is the speed by which the gain 320 (as applied to the incoming signal 107*a*) is reduced from the beginning of the speech envelope 205. A shorter attack time will increase the speed by which the dynamic range is reduced. The compressor attack time may be increased or decreased to add intelligibility to speech sounds.

The compressor release time ($t_{r(compressor)}$) is the speed by which the gain 320 is increased back to a nominal level when the end of the speech envelope 205 occurs. A shorter release time will increase the speed by which the dynamic range is increased. The compressor release time may be increased or decreased to add intelligibility to speech sounds. The compressor 130 allows the average loudness of an incoming speech signal 107*a* to be increased without the speech peaks distorting or becoming painful to listen to. In this way it is easier to hear the subtle, low level inflections of a person's voice and so it is easier to understand. Also, the compressor 130 can clamp down (or minimize) a harmful tone or other aberrant tone in the incoming signal.

Another possible method to increase the intelligibility in the speech content of the incoming signal is by selectively turning on or off the gain of the expander and/or the attenuation of the compressor, when appropriate.

As with the high pass filter 120 and low pass filter 115, there are several methods for implementing the expander 125 and compressor 130. These methods include, for example, the use of variable gain cells, multipliers, log amplifiers and modulators.

Figure 5:
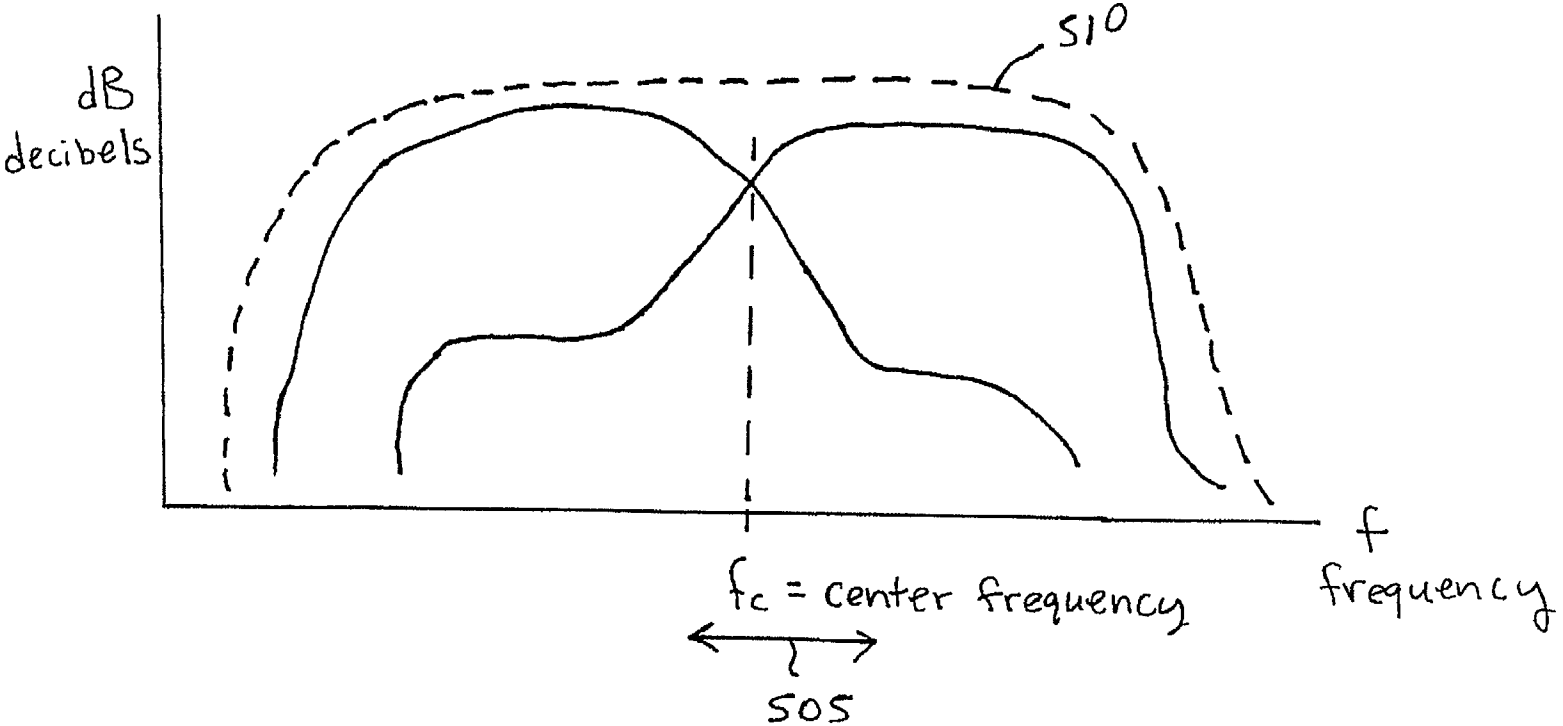
FIG. 5 is a waveform diagram illustrating the adjustable parameters for a pass band contour in an apparatus according to an embodiment of the invention.

FIG. 5 is a frequency response diagram illustrating the adjustable parameters for a pass band filter contour 135 in an apparatus according to an embodiment of the invention. The intelligibility of speech sounds can be improved by selecting an appropriate frequency response to control the gain at frequency bands and so this boosts the bands that contain the most signal information and attenuates bands which contain more noise. To vary the frequency response, the center frequency ($f_C$) can be shifted (505) to the left or right, and/or the contour of the lobe 510 can be varied. The center frequency is the exact frequency to which the filter is tuned, and is where the boost or cut of the frequency response pivots To adjust the contour of the lobe 510, the resonance ("Q") of the apparatus can be adjusted, since Q determines bandwidth.

The adjustment for the center frequency and/or the lobe 510 contour can add intelligibility to speech sounds in the incoming signals. For example, in order to emphasize certain wanted sounds and/or de-emphasize certain unwanted sounds, the center frequency can be shifted and/or the lobe 510 contour can be varied. If, for example, the caller has a low pitched voice, the frequency response can be adjusted so that the pitch is increased in the sound of the caller's voice. As another example, if the caller has a high pitched voice, the frequency response can be adjusted so that the pitch is decreased in the sound of the caller's voice.

In an embodiment, the incoming signal 107*a* will be sequentially processed by the blocks 115 to 135 in the signal processing stage 110. For example, the filters 115 and 120 will first apply filtering functions on the signal 107*a* and the expander 125 will apply expander functions on the signal

107*a*. The compressor 130 will then apply compressor function on the signal 107*a*. The pass band contour 135 will then apply its pass band contour function on the signal 107*a*. In various embodiments of the invention, the compressor function and/or pass band contour function may be omitted.

An incoming signal 107*a* with speech sound is received on a communications headset that has the signal processing stage 110, and the signal processing parameters may be modified according to the user's perception or analysis of the incoming signal 107*a*. The selector switch 105 permits a user to manually select from predetermined combinations of processing parameters to modify the sound quality of the incoming signal 107*a* as variations occur in speech sound quality of the incoming signal 107*a*. The selector switch 105 permits the user to change signal processing parameters in real-time such that during an on-going phone conversation, if the speech quality suddenly degrades, then the user can use the selector switch 105 to modify the signal processing parameters in order to increase intelligibility for speech sounds in the incoming signal 107*a*. During the on-going phone conversation, if the degradation stops then the user can use selector switch 105 to modify the signal processing parameters back to, for example, a default setting. The modifications of parameters can be performed "real-time" during the course of a single telephone conversation.

Figure 6:
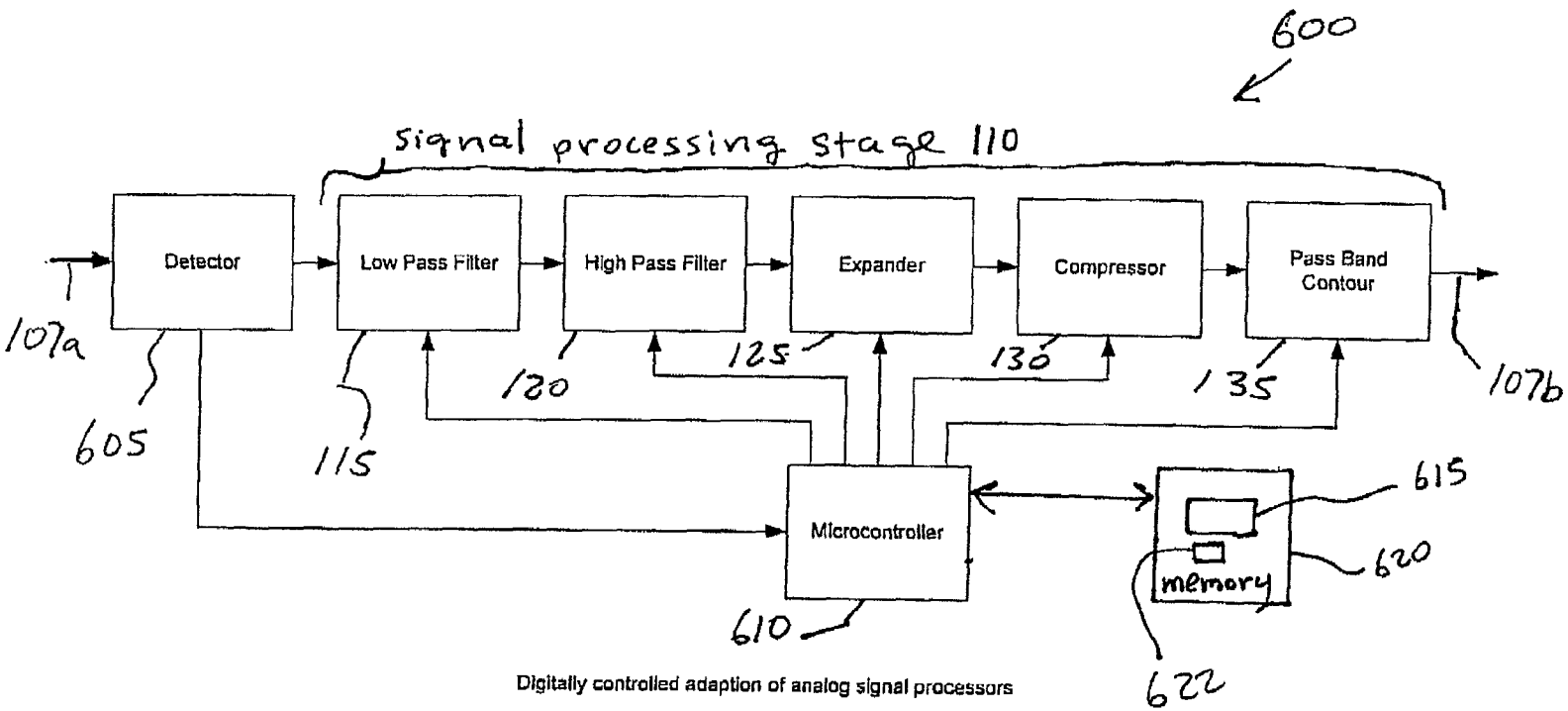
FIG. 6 is a block diagram of an apparatus in accordance with another embodiment of the invention.

FIG. 6 is a block diagram of an apparatus 600 in accordance with another embodiment of the invention. In an embodiment, the apparatus 600 includes a signal processing stage 110, a detector 605, and a microcontroller 610. The detector 605 detects the level (including the signal to noise ratio) and frequencies of the incoming signal 107*a* and communicates the detected levels and frequencies to the microcontroller 610. In response to the detected levels and frequencies, the microcontroller 610 can adaptively adjust parameters for controlling characteristics of the signal processing stage 110 components. Thus, in an embodiment, when the user picks up the call, he/she would initially hear a full band audio, and the microcontroller 610 can control the signal processing stage 610 to modify the incoming signal 107*a* so that the caller's voice would step out from the noise.

In an embodiment of the invention, the compressor 130 and/or the pass band contour stage 135 may be omitted in the signal processing stage 110.

The detector 605 can typically detect and measure the peak signal level and the rms (root mean square) average of the incoming signal 107*a*, and the noise floor for a channel. The peak signal level is generally the maximum amplitude of the incoming signal 107*a*. The rms average is generally the average value of the power of the signal over a period of time. As noted above, the noise floor is the amplitude of the incoming signal 107*a* when no speech utterances are present.

The signal to noise ratio is the ratio of the peak signal level to the rms average. The signal to noise ratio measurement can be used by the microcontroller 610 to determine and adjust the appropriate settings of all signal processing blocks such as the low pass cutoff frequency, the high pass cutoff frequency, and the contour 510 (see FIG. 5) in order to increase the intelligibility of speech sounds in the incoming signal 107*a*.

Based on the measurements made by the detector 605, the microcontroller 610 can, for example, execute a software or module 615 stored in an internal or external memory 620 to control the settings of the signal processing stage 110. For example, the microcontroller 610 can adjust the settings of the low pass filter 115, high pass filter 120, expander 125, compressor 130, and/or pass band contour 135 to enhance the intelligibility of incoming signal 107*a*. The enhanced signal is shown as output signal 107*b*.

In general, as the signal to noise ratio of the incoming signal 107*a* deteriorates, the signal processing blocks are modified as follows: The low pass filter cut off frequency is decreased from the maximum bandwidth upper frequency limit of approximately 7 KHz to a minimum of approximately 1 KHz; the high pass filter cut off frequency is increased from the maximum bandwidth lower frequency limit of about 100 Hz to a minimum of approximately 600 Hz.

The expander threshold is raised from a minimum of approximately −60 dB relative to the channel ceiling (maximum signal level before clipping) to a maximum of approximately −20 dB, ideally about 10 dB above the average noise floor level and its attack and release times are reduced from a maximum of approximately 150 ms and approximately 300 ms, respectively, to a minimum of approximately 5 ms and 10 ms; the compressor threshold is reduced from approximately 0 dB relative to the channel ceiling to a minimum of approximately −40 dB, ideally about 3 dB above the speech average level and its attack and release times reduced from approximately 250 ms and 50 ms, respectively, to approximately 50 ms and 1 ms; finally, the pass band contour is adjusted to give peaking in, for example, the 1.5 KHz to 2.5 KHz band whenever bandwidth adjustment allows. Finally, the output gain of the system is adjusted to maintain constant loudness as, for example, defined by Recommendation P.79 of the International Telecommunication Union (CCITT). Examples of configuration parameter values are discussed below.

As similarly stated above, in an embodiment, the incoming signal 107*a* will be sequentially processed by the blocks 115 to 135 in the signal processing stage 110. For example, the filters 115 and 120 will first apply filtering functions on the signal 107*a* and the expander 125 will apply expander functions on the signal 107*a*. The compressor 130 will then apply compressor functions on the signal 107*a*. The pass band contour 135 will then apply its function on the signal 107*a*. As noted above, in various embodiments of the invention, the compressor function and/or pass band contour function may be omitted.

An incoming signal 107*a* with speech sounds is received on a communications headset that has the signal processing stage 110, and the signal processing configuration parameters are modified according to analysis of the incoming signal 107*a* by the microcontroller 610 so that the sound quality of the incoming signal 107*a* is modified as variations occur in speech sound quality of the incoming signal 107*a*. The microcontroller 610 can change signal processing parameters in real-time such that during an on-going phone conversation, if speech quality suddenly degrades, then the microcontroller 610 can modify the signal processing parameters in order to increase intelligibility for speech sounds in the incoming signal 107*a*. During the on-going phone conversation, if the degradation stops, then the microcontroller 610 can modify the signal processing parameters back to, for example, a default setting. The modifications of parameters are performed real-time during the course of a single telephone conversation.

In one embodiment, the software 615 is programmed with code so that the controller 610 will generate particular commands to the signal processing stage 110 if particular levels or frequencies in the incoming signal 107*a* are detected by the detector 605. The microcontroller 610 can, for example, automatically set the low pass cutoff frequency, high pass cutoff frequency, expander threshold, expander attack time, expander release time, compressor threshold, compressor attack time, compressor release time, center frequency, turn on/off the expander gain, turn on/off the compressor gain, and/or set the lobe level/shape in order to enhance the intelligibility of the speech sounds in the incoming signal 107*a*. For example, if the incoming signal 107*a* has a high degree of noise, then the microcontroller 610 can control the appropriate components in the signal processing stage 110 to reduce the noise sound and to enhance the intelligibility of the caller's voice. As another example, if the caller has a low pitched voice or a high pitched voice, then the microcontroller 610 can control the appropriate components in the signal processing stage 110 to increase the sound pitch or decrease the sound pitch, respectively, of the caller's voice. In this example, the microcontroller 610 would determine the frequency by monitoring the signal detector 605 output and determine the time spans between the signal crossings at zero level. When the measured spans are relatively constant and repeat in succession, then a frequency calculation can be achieved. Calculation of frequency is 1/T in cycles per second, where T equals 2 times the measured span time. The frequency or time could then directly select (as in a case statement or table look-up) from a pre-determined matrix 662 (see, e.g., FIG. 6) of signal processing parameters that optimize pitch (and other components) that can result in improved intelligibility. Other parameter detectors or monitors can also be inputs to the microcontroller (or CPU) 610 algorithm to help determine the best choice in the matrix 662. For example, activity or lack of activity on the compressor 130 or expander 125 timing elements (for attack and release) can determine whether the signal levels or energy is optimal for the user's intelligibility or can help determine whether the frequency content is high or lower in amplitude. Any order of measurable parameters could be used singularly or in combination to determine a selection within a matrix 662 of intelligibility enhancement settings. In another embodiment, the values in the matrix 662 (or values in range values in matrix 662) may be selected by use of known linear interpolation methods based upon the measurable parameters in the incoming signal 107*a*.

Examples of some of the set of predetermined configurations parameters that can be selected manually via selector switch 105 (or adaptively selected by microcontroller 610 or by adaptive algorithm 740 in DSP) are now discussed. These example sets of predetermined signal processing configuration parameters are used in response to the particular sound conditions in the caller's environment or telephony environment so that the speech sounds are made more intelligible. Other suitable sets of predetermined configuration parameters may be used in an embodiment of the invention. As an example, these configuration parameters may be configured as predetermined combinations of processing parameters within the selection switch 105 (FIG. 1), or may be stored in the memory 620 (FIG. 6).

The incoming signal 107*a* is first detected and measured (either by the user in the apparatus 100 of FIG. 1 or by the detector 605 in FIG. 6 or detector 705 in FIG. 7), and information pertaining to the frequency content of the current window and signal envelope amplitude of the incoming signal 107*a* are calculated. Signal statistics such as noise floor, speech signal average level, and speech signal peak level may be updated, and then a new set of signal processing configuration parameters are computed and programmed.

The selector switch 105 in the apparatus 100 (FIG. 1) may be used to select from predetermined combinations of signal processing parameters to enhance the speech intelligibility in the incoming signal 107*a*. The microcontroller 610 of the apparatus 600 (FIG. 6) selects the combination of signal processing parameters, while the adaptive algorithm 740 computes the combination of signal processing parameters in a matrix 662, to enhance the speech intelligibility in the incoming signal 107*a*. The combination of signal processing parameters below are provided by way of example only and should not be construed as limiting the scope of the present invention.

For example, one set of signal processing parameters can enhance the intelligibility of speech sounds if the caller is in a very high noise environment such as, for example, a moving car with the car windows open or is using a cellular phone. These ranges of signal processing parameters include, for example, a narrower bandwidth setting (e.g., approximately 500 Hz to 2.0 KHz), shorter expander attack time and release time (e.g., approximately 20 ms and 50 ms respectively), higher expander threshold level (e.g., approximately −10 dB relative to average speech level). In the above caller environment, the compressor attack time and release time may be set to, for example, a range of 75 ms and 5 ms, respectively, and the compressor threshold may be set to, for example, a range of 0 to 3 dB above the average speech level, to minimize harmful or aberrant tones and to distinguish subtle, low level inflections of a caller's voice. The center frequency ($f_c$) may be set to a value in the low range of the passband, e.g., about 600 Hz, while the contour of the lobe 510 of the pass band contour may be set to give a rising response of approximately 6 dB per octave throughout the narrow passband, for example. The center frequency ($f_c$) and pass band contour adjustments helps to adjust the caller's speech sounds to achieve increased intelligibility. As discussed above, other measurable parameters detected from the caller's environment can be used singularly or in combination to select within a matrix of signal processing parameters. As also discussed below, signal processing techniques may be used in defined frequency bins to allow finer resolution and increase control of the signal to noise ratio of the call.

Another set of signal processing parameters can enhance the intelligibility of speech sounds if the caller is in a low noise environment such as a quiet or acoustically-treated room. For example, the signal processing parameters may be the following: bandwidth setting at a range of approximately 100 Hz to 7.0 KHz, expander-attack time and release time at a range of approximately 125 ms and 250 ms, respectively, expander threshold level at a range of approximately −50 to −60 dB relative to the channel ceiling, compressor attack time and release time at a range of approximately 200 ms and 15 ms, respectively, compressor threshold at a range of approximately −6 to −12 dB relative to the channel ceiling, center frequency ($f_c$) around 1 KHz but with the contour of the lobe 510 set flat to give the most natural sound possible, for example. Alternatively or additionally, the gain of the expander and the attenuation of the compressor may be turned off in this example.

Another set of signal processing parameters can enhance the intelligibility of speech sounds if the caller is in a typical environment with non-distracting ambient noise. For example, the signal processing parameters may be the following: bandwidth setting at a range of approximately 00 Hz to 3.3 KHz, expander attack time and release time at a range of approximately 100 ms and 200 ms, respectively, expander threshold level at a range of approximately −30 dB to −40 dB relative to the channel ceiling, compressor attack time and release time at a range of approximately 150 ms and 10 ms, respectively, compressor threshold at a range of approximately −10 to −20 dB relative to the channel ceiling, center frequency ($f_c$) at about 1 KHz, and contour of the lobe 510 to give peaking of about +6 dB in the 2.0 KHz to 3.0 KHz range, for example.

Another set of signal processing parameters can enhance the intelligibility of speech sounds if the caller has a high (or low) pitched voice and is assumed to be in a typical environment with non-distracting ambient noise. For example, in response to a caller with a high pitched voice, the predetermined signal processing parameters may be the following: bandwidth setting at a range of approximately 300 Hz to 3.3 KHz, expander attack time and release time at a range of approximately 100 ms and 200 ms, respectively, expander threshold level at a range of approximately −30 to −40 dB relative to the channel ceiling, compressor attack time and release time at a range of approximately 150 ms and 10 ms, respectively, compressor threshold at a range of approximately −10 to −20 dB relative to the channel ceiling, center frequency ($f_c$) about 1 KHz, and contour of the lobe 510 such that the high frequencies are attenuated by no more than approximately 6 dB, for example.

In response to a caller with a low pitched voice, the signal processing parameters may be, for example, the following: bandwidth setting at a range of approximately 300 Hz to 3.3 KHz, expander attack time and release time at a range of approximately 100 ms and 200 ms, respectively, expander threshold level at a range of approximately −30 to −40 dB relative to the channel ceiling, compressor attack time and release time at a range of approximately 150 ms and 10 ms, respectively, compressor threshold at a range of approximately −10 to −20 dB relative to the channel ceiling, center frequency (fc) at about 700 Hz, and contour of the lobe 510 to give attenuation of the low frequency range of no more than approximately 6 dB, for example.

Thus, the frequency response, bandwidth, and non-linear parameters can be determined in order to optimize the intelligibility of the incoming signal 107*a*. An analog adapter with the microcontroller 610 can then instantly re-program the adapter to one of various configurations by, for example, having the user press a button (or other selection mechanism) on the adapter. Thus, in an embodiment, the adapter can automatically select the optimal configuration to improve the intelligibility of the speech sound.

Figure 7:
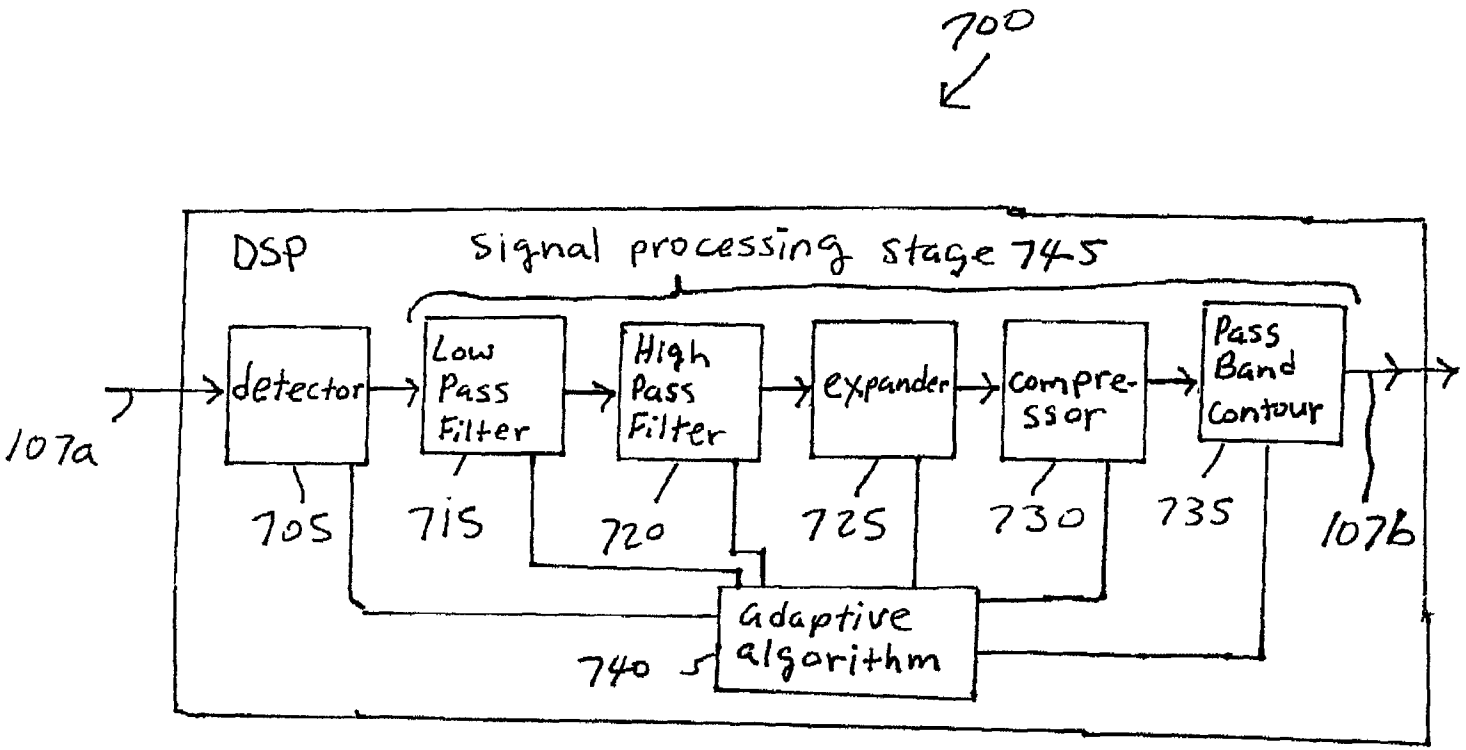
FIG. 7 is a block diagram of an apparatus in accordance with another embodiment of the invention.

FIG. 7 is a block diagram of an apparatus 700 in accordance with another embodiment of the invention. The apparatus 700 may be implemented in, for example, a digital signal processor, and may perform functions as represented in the following functional blocks: detector 705, low pass filter 715, high pass filter 720, expander 725, compressor 730, and/or pass band contour 735. The functional blocks 715 through 735 form a signal processing block or stage 745. In one embodiment, the compressor 730 and/or pass band contour 735 may be omitted. An adaptive algorithm (or module) 740 permits the apparatus 700 to control the functional blocks 705 through 735 so that the intelligibility of an incoming signal 107*a* is enhanced based upon the measurements performed by the detection block 705 on the incoming signal 107*a*. The adaptive algorithm 740 can, for example, automatically set the low pass cutoff frequency, high pass cutoff frequency, expander threshold, expander attack time, expander release time, compressor threshold, compressor attack time, compressor release time, center frequency, and/or lobe 510 level/shape by selecting values in a matrix in order to enhance the intelligibility of the speech sounds in the incoming signal 107*a*. The enhanced signal is shown as output signal 107*b*.

In an embodiment, the incoming signal 107*a* will be sequentially processed by the blocks 715 to 735 in the signal processing stage 745. For example, the filters 715 and 720 will first apply filtering functions on the signal 107*a* and the expander 725 will apply expander functions on the signal 107*a*. The compressor 730 will then apply compressor functions on the signal 107*a*. The pass band contour 735 will then apply its function on the signal 107*a*. As noted above, the compressor function and/or pass band contour function are optional.

An incoming signal 107*a* with speech sounds is received on a communications headset that has the signal processing stage 745, and the signal processing parameters are modified according to analysis of the incoming signal 107*a* based on the adaptive algorithm 740 so that the sound quality of the incoming signal 107*a* is modified as variations occur in speech sound quality of the incoming signal 107*a*. The adaptive algorithm 740 can change signal processing parameters in real-time such that during an on-going phone conversation, if speech quality suddenly degrades, then the adaptive algorithm 740 can modify the signal processing parameters in order to increase intelligibility for speech sounds in the incoming signal 107*a*. During the on-going phone conversation, if the degradation stops, then the adaptive algorithm 740 can modify the signal processing parameters back to, for example, a default setting. The modifications of parameters are performed real-time during the course of a single telephone conversation.

For a headset adapter system that use DSP technology and therefore has the ability to monitor the audio signals passing through them, the selection could be made automatically. By using an intelligibility measurement such as an algorithm to determine the modulation depth of the speech signal to obtain an estimation of the signal to noise ratio, an adaptive algorithm 740 could be used to compute and/or choose the best configuration (or configuration parameters) that is optimized for particular telephony environments. Statistically, normal speech has a peak to average ratio (sometimes referred to as crest factor) of 15 dB. These two measurements are easily made and so if the ratio of these measurements is less than 15 dB, then it can be assumed that noise is present which is increasing the average measurement while not affecting the peak measurement. Spectrum analysis of the incoming signal can confirm whether this is wide band noise (white noise for example) or narrow band such as a single tone. Additionally, the use of a speech detector allows measurement of the incoming signal level when there is no speech present, i.e., direct measurement of the noise floor. When the user picks up the call, he/she would initially hear a full band audio, but the adapter would quickly home in on the speech signal so that the voice of the caller would be distinguishable from the noise signals. The speed and power of the Digital Signal Processor allows much more information about the incoming signal to be learned. The frequency spectrum of the noise floor and the speech utterances of the incoming signal 107*a* can be determined and so the high pass 120, low pass 115 and pass band contour 135 filters can be configured to optimally pass only those frequency bands which contain useful speech information. This can be done with much more precision and accuracy than by observing the effect on the signal to noise ratio of a filter adjustment or by setting a generic bandwidth depending on the incoming signal to noise ratio.

Figure 8:
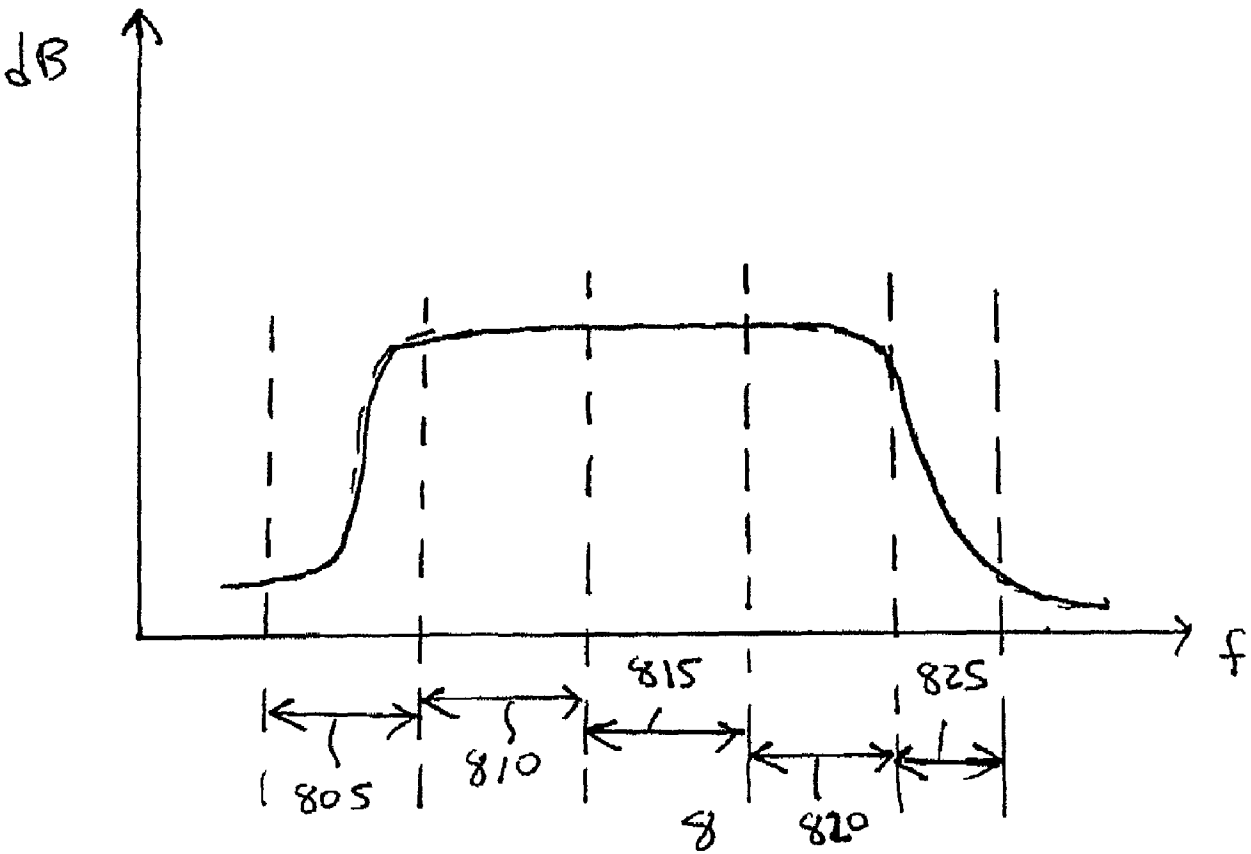
FIG. 8 is a waveform diagram illustrating a method of measuring within frequency bins, as performed by an embodiment of the apparatus shown in FIG. 7.

FIG. 8 is a block diagram illustrating a method of measuring within frequency bins (bands), as performed by an embodiment of the apparatus shown in FIG. 7. The adaptive algorithm 740 can, for example, define frequency bands (bins) in which measurements will be made for the signal to noise ratio. The number of bins and the frequency range within each bin may vary depending on the processing power and capability of the target DSP core. In the example of FIG. 8, the bins are shown as 805-825. The signal processing outlined above is then performed on each frequency bin to allow even finer resolution and control of the signal to noise ratio. If the speech content is high and the signal to noise ratio is above a defined threshold in a bin, then the signal content in that particular bin will be amplified or enhanced to improve the intelligibility of the incoming signal 107*a* and allowed to pass through to the output 107*b*. On the other hand, if the speech content is low and the signal to noise ratio is below a defined threshold in a bin, then the signal content in that particular bin will be not be amplified and the signal content's contribution to the output signal 107*b* will be reduced. In addition, by observing the noise floor of each bin, the type of noise present in the incoming signal 107*a* can be characterized and the adaptive algorithm 740 used to calculate the signal processing configuration parameters can be adjusted to address the specific signal impairment. A narrow band noise signal will rely on frequency filtering more than expansion and compression, while a broadband noise signal will rely more on expansion and compression rather than filtering. With greater information of the nature of the impairment, the signal processing tools outlined above can be more effectively put to use to enhance the quality of the communication channel.

Figure 9:
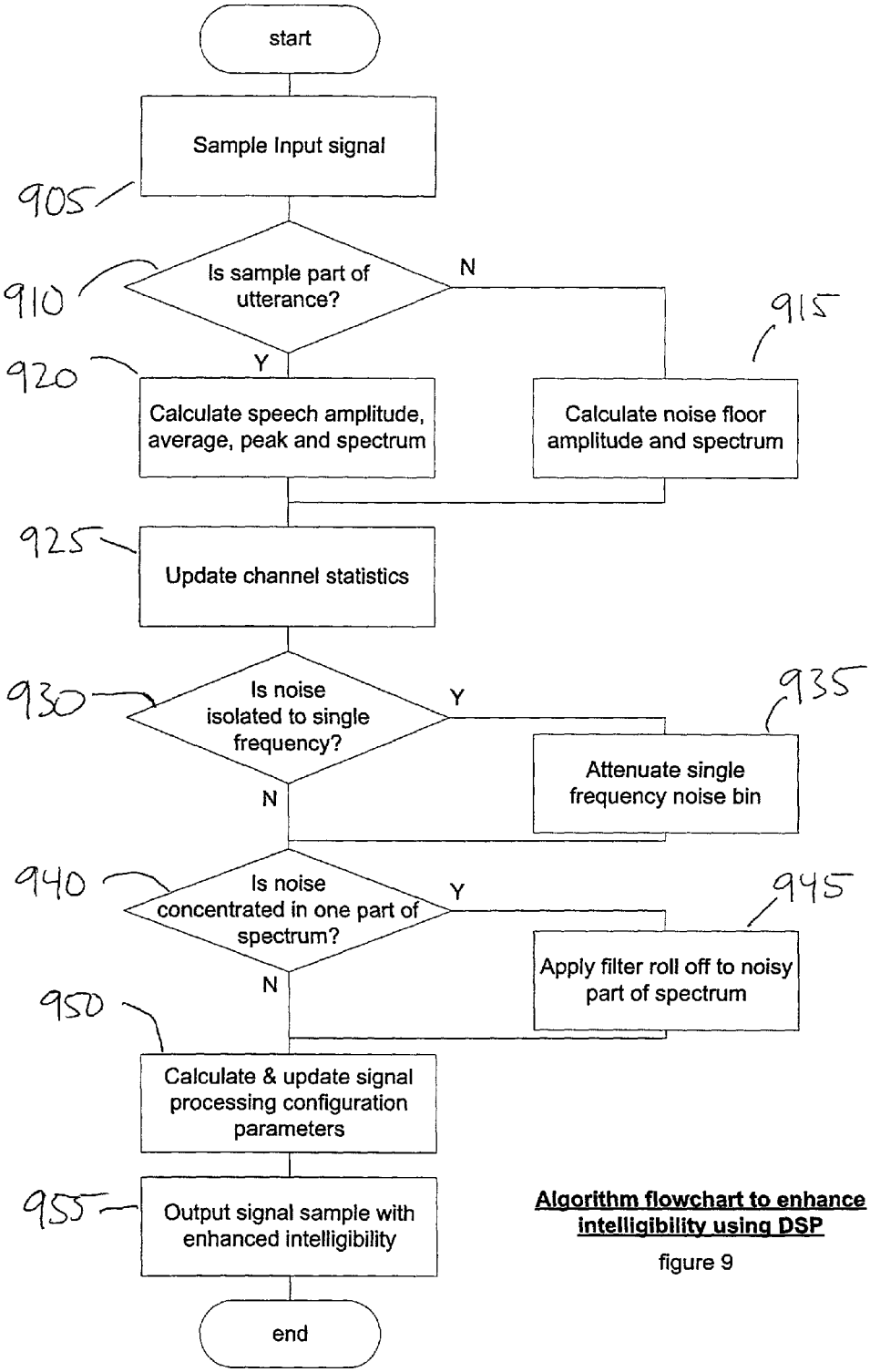
FIG. 9 is a flowchart of a method in accordance with an embodiment of the invention.

FIG. 9 is a flowchart of a method 900 to enhance intelligibility by use of a digital signal processor, in accordance with an embodiment of the invention. An incoming signal is first detected and measured (sampled) (905). It is then determined (910) if the sampled incoming signal is part of an utterance. If not, then calculation is performed (915) on information pertaining to the frequency content of the current window and signal envelope amplitude. In one embodiment, the noise floor amplitude and spectrum are calculated. If, in the determination (910), the sampled incoming signal is part of an utterance, then a calculation is performed (920) on the speech amplitude, average, peak, and spectrum. The channel statistics are then updated (925).

It is then determined (930) if the noise in the incoming signal is isolated to a single frequency. If so, then the single frequency noise bin is attenuated (935). If not, then it is determined (940) if the noise is concentrated in one part of the spectrum. If so, then a filter roll off is applied (945) to the noise filled part of the spectrum. If the noise is not concentrated in one part of the spectrum, then the signal processing parameters are calculated and updated (action 950). For example, signal statistics such as noise floor, speech signal average level and speech signal peak level may be updated and then a new set of signal processing parameters computed and programmed. The parameters may be adjusted or selected by, for example, selecting parameters from a matrix. The output sampled signal is then generated (955) with enhanced intelligibility for speech sounds.

In the embodiments described above, additional measurements and processing may be performed. For example, for a detected frequency tone that remains constant for a certain amount of time (e.g., 200 milliseconds), the tone may be muted because the tone may be an aberrant tone. Power measurements may also be made in particular frequency bins in the embodiment shown in FIG. 7. The various embodiments described above may be used to increase the sound quality of a signal from a wireless, voice-over-Internet-Protocol (VOIP), plain old telephone system (POTS), cellular phone system, and/or next generation products or systems that cause artifacts in speech signals.

Reference throughout this specification to "one embodiment", "an embodiment", or "a specific embodiment" means that a particular feature, structure, or characteristic described in connection with the embodiment is included in at least one embodiment of the present invention. Thus, the appearances of the phrases "in one embodiment", "in an embodiment", or "in a specific embodiment" in various places throughout this specification are not necessarily all referring to the same embodiment. Furthermore, the particular features, structures, or characteristics may be combined in any suitable manner in one or more embodiments.

Other variations and modifications of the above-described embodiments and methods are possible in light of the foregoing teaching.

Further, at least some of the components of an embodiment of the invention may be implemented by using a programmed general purpose digital computer, by using application specific integrated circuits, programmable logic devices, or field programmable gate arrays, or by using a network of interconnected components and circuits. Connections may be wired, wireless, by modem, and the like.

It will also be appreciated that one or more of the elements depicted in the drawings/figures can also be implemented in a more separated or integrated manner, or even removed or rendered as inoperable in certain cases, as is useful in accordance with a particular application.

It is also within the scope of the present invention to implement a program or code that can be stored in a machine-readable medium to permit a computer to perform any of the methods described above.

Additionally, the signal arrows in the drawings/Figures are considered as exemplary and are not limiting, unless otherwise specifically noted. Furthermore, the term "or" as used in this disclosure is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A method of enhancing the intelligibility of speech sounds in a communications headset, the method comprising:

a) detecting an incoming signal having both speech content and ambient noise, said ambient noise including degrading artifacts, noise, and distortions;

b) based upon detectable parameters in the incoming signal including central frequency and pass band contour, determining:

1) a high pass cutoff frequency value and a low pass cutoff frequency value to define a pass band filtering function that is narrow at frequencies where high and low frequency ambient noise is to be filtered out and not to be amplified and speech signals are to be amplified and increased in Signal to Noise Ratio, and 2) thereafter determining an expander function including:

i) an expander threshold level below speech level and above ambient noise level, ii) an expander attack time to increase gain when speech signals are detected, and iii) an expander release time for the expander function to reduce gain when the speech signals are no longer detected; and c) sequentially 1) applying the filtering function by decreasing the low pass cut off frequency from a maximum bandwidth upper frequency limit, increasing the high pass cut off frequency from a maximum bandwidth lower frequency limit to thereby shift the central frequency of the incoming signal and, 2) raising the expander threshold, reducing the expander attack time, and reducing the expander release time; as the signal to noise ratio of the incoming signal deteriorates so that high and low frequency noise is separated from speech whereby the degraded sound quality of the incoming signal is modified in real-time to increase intelligibility as variations occur in speech sound quality of the incoming signal.

2. The method of claim 1, wherein the combination of signal processing parameters further includes a compressor threshold level, a compressor attack time to reduce gain, a compressor release time to increase gain for a compressor function, and a compressor gain value.

3. The method of claim 2, further comprising:

sequentially applying the compressor function to the incoming signal.

4. The method of claim 1, wherein the parameters are used to set the characteristics of a signal processing stage in a headset adapter.

5. The method of claim 1, wherein the action of determining the combination of signal processing configuration parameters comprises:

automatically determining the combination of signal processing parameters in response to the incoming signal.

6. The method of claim 1, wherein the action of determining the combination of signal processing parameters comprises:

manually determining the combination of signal processing parameters in response to the incoming signal.

7. The method of claim 1, further comprising:

measuring a signal to noise ratio value of the incoming signal in each of a plurality of frequency bins.

8. The method of claim 7, wherein:

if a speech content is high and the signal to noise ratio value is above a defined threshold in a frequency bin, then amplifying a signal content in the frequency bin.

9. The method of claim 7, wherein:

if the speech content is low and the signal to noise ratio value is above a defined threshold in a frequency bin, then preventing amplification of a signal content in the frequency bin.

10. The method of claim 1, wherein the action of applying the filtering function and expander function, further comprises:

muting a detected frequency tone that remains constant for a particular time interval.

11. The method of claim 1, wherein the incoming signal is received from a communications network.

12. The method of claim 11, wherein the communication network is one of: a telephone network, cellular phone network, and voice-over-Internet-Protocol system.

13. The method of claim 1, where the detectable parameters in the incoming signal include information pertaining to the frequency content and signal envelope amplitude of the incoming signal.

14. An apparatus for enhancing the intelligibility of speech sounds in a communications headset, the apparatus comprising:

a detector configured to detect an incoming signal with speech content having ambient noise including degrading artifacts, noise, and distortion;

a signal processing stage coupled to the detector, the signal processing stage comprising a filter and an expander, whereby based upon detectable parameters in the incoming signal including central frequency and pass band contour, the signal processing stage determines:

1) a high pass cutoff frequency value and a low pass cutoff frequency value to define a pass band filtering function that is narrow at frequencies where high and low frequency ambient noise is to be filtered out and not to be amplified and speech signals are to be amplified and increased in Signal to Noise Ratio, and 2) an expander function including:

i) an expander threshold level below speech level and above ambient noise level, ii) an expander attack time to increase gain when speech signals are detected, and iii) an expander release time for the expander function to reduce gain when the speech signals are no longer detected; and the signal processing stage sequentially 1) applying the filtering function by decreasing the low pass cut off frequency from a maximum bandwidth upper frequency limit, increasing the high pass cut off frequency from a maximum bandwidth lower frequency limit to thereby shift the central frequency of the incoming signal and, 2) raising the expander threshold, reducing the expander attack time, and reducing the expander release time; as the signal to noise ratio of the incoming signal deteriorates so that high and low frequency noise is separated from speech whereby the degraded sound quality of the incoming signal is modified in real-time to increase intelligibility as variations occur in speech sound quality of the incoming signal; and a microcontroller configured to determine a combination of signal processing parameters including a high pass cutoff frequency value and a low pass cutoff frequency value for the filtering function, and an expander threshold level, an expander attack time, and an expander release time for the expander function, based upon detectable parameters in the incoming signal.

15. The method of claim 14 wherein the incoming signal includes a test signal.

16. The apparatus of claim 14, wherein the microcontroller is configured to permit the signal processing stage to mute a detected frequency tone that remains constant for a particular time interval.

17. The apparatus of claim 14, the incoming signal is received from a communications network.

18. The apparatus of claim 17, wherein the communication network is one of: a telephone network, cellular phone network, and voice-over-Internet-Protocol system.

19. The apparatus of claim 14, where the detectable parameters in the incoming signal include information pertaining to the frequency content and signal envelope amplitude of the incoming signal.

20. The apparatus of claim 14, wherein the detector, microcontroller, and signal processing stage are implemented in a digital signal processing chip.

21. The apparatus of claim 14, wherein the signal processing stage further comprises:

a compressor stage configured to sequentially provide a compressor function to the incoming signal; and wherein the microcontroller is further configured to determine a compressor threshold level, a compressor attack time, and a compressor release time for the compressor function.

22. The apparatus of claim 14, wherein the signal processing stage further comprises:

a pass band contour stage configured to sequentially provide a pass band contour function to the incoming signal; and wherein the microcontroller is further configured to determine a center frequency value and pass band contour for the pass band contour function.

23. The apparatus of claim 14, wherein the microcontroller is further configured to set an expander gain value for the expander function.

24. The apparatus of claim 14, wherein the microcontroller is further configured to set a compressor gain value for the compressor function.

25. The apparatus of claim 14, wherein the incoming signal includes a test signal.

26. The apparatus of claim 14, wherein the signal processing stage and microcontroller are implemented in a headset adapter.

27. The apparatus of claim 14, wherein the microcontroller automatically determines the combination of signal processing parameters in response to the incoming signal.

28. The apparatus of claim 14, wherein the microcontroller is configured to permit the signal processing stage to the low pass cut off frequency from a maximum bandwidth upper frequency limit, increase the high pass cut off frequency from a maximum bandwidth lower frequency limit, raise the expander threshold, reduce the expander attack time, and reduce the expander release time, as the signal to noise ratio of the incoming signal deteriorates.

29. An article of manufacture, comprising:

a machine-readable medium having stored thereon instructions to:

a) detecting an incoming signal having both speech content and ambient noise, said ambient noise including degrading artifacts, noise, and distortions;

b) based upon detectable parameters in the incoming signal including central frequency and pass band contour, determining:

1) a high pass cutoff frequency value and a low pass cutoff frequency value to define a pass band filtering function that is narrow at frequencies where high and low frequency ambient noise is to be filtered out and not to be amplified and speech signals are to be amplified and increased in Signal to Noise Ratio, and 2) thereafter determining an expander function including:

i) an expander threshold level below speech level and above ambient noise level, ii) an expander attack time to increase gain when speech signals are detected, and iii) an expander release time for the expander function to reduce gain when the speech signals are no longer detected; and c) sequentially 1) applying the filtering function by decreasing the low pass cut off frequency from a maximum bandwidth upper frequency limit, increasing the high pass cut off frequency from a maximum bandwidth lower frequency limit to thereby shift the central frequency of the incoming signal and, 2) raising the expander threshold, reducing the expander attack time, and reducing the expander release time;

as the signal to noise ratio of the incoming signal deteriorates so that high and low frequency noise is separated from speech whereby the degraded sound quality of the incoming signal is modified in real-time to increase intelligibility as variations occur in speech sound quality of the incoming signal.

30. An apparatus for enhancing the intelligibility of speech sounds in a communications headset, the apparatus comprising:

a digital signal processing stage for determining:

1) a high pass cutoff frequency value and a low pass cutoff frequency value to define a pass band filtering function that is narrow at frequencies where high and low frequency ambient noise is to be filtered out and not to be amplified and speech signals are to be amplified and increased in Signal to Noise Ratio, and 2) an expander function including:

i) an expander threshold level below speech level and above ambient noise level, ii) an expander attack time to increase gain when speech signals are detected, and iii) an expander release time for the expander function to reduce gain when the speech signals are no longer detected;

the digital signal processing stage configured to detect an incoming signal with speech content and having ambient noise including degrading artifacts, noise, and distortions, and to adaptively provide a pass band filtering function with a bandwidth pattern narrow at frequencies where ambient noise is to be filtered out so as not to be amplified and information bearing signals are to be amplified and increased in Signal to Noise Ratio, and an expander function to the incoming signal in a sequential manner so that the degraded sound quality of the incoming signal may be modified real-time to increase intelligibility as variations occur in speech sound quality of the incoming signal, the digital signal processor configured to determine a combination of signal processing parameters including a central frequency and a pass band contour, a high pass cutoff frequency value and a low pass cutoff frequency value for the filtering function, and an expander threshold level, an expander attack time, and an expander release time for the expander function, based upon detectable parameters in the incoming signal.

31. The apparatus of claim 30, where the detectable parameters in the incoming signal include information pertaining to the frequency content and signal envelope amplitude of the incoming signal.

32. The apparatus of claim 30, wherein the digital signal processor is configured to measure a signal to noise ratio value of the incoming signal in each of a plurality of frequency bins.

33. The apparatus of claim 32, wherein the digital signal processor is configured to amplify a signal content in a frequency bin, if a speech content is high and the signal to noise ratio value is above a defined threshold in the frequency bin.

34. The apparatus of claim 32, wherein the digital signal processor is configured to substantially prevent amplification of a signal content in a frequency bin, if the speech content is low and the signal to noise ratio value is above a defined threshold in the frequency bin.

35. The apparatus of claim 30, wherein the digital signal processor is further configured to determine a compressor threshold level, a compressor attack time, and a compressor release time for a compressor function and sequentially provide the compressor function to the incoming signal.

36. The apparatus of claim 30, wherein the digital signal processor is further configured to determine a center frequency value and pass band contour for a pass band contour function, and sequentially provide the pass band contour function to the incoming signal.

37. The apparatus of claim 30, wherein the digital signal processor is further configured to set an expander gain value for the expander function.

38. The apparatus of claim 30, wherein the digital signal processor is further configured to set a compressor gain value for the compressor function.

39. The apparatus of claim 30, wherein the incoming signal includes a test signal.

40. The apparatus of claim 30, wherein the digital signal processor is implemented in a headset adapter.

41. The apparatus of claim 30, wherein the digital signal processor automatically determines the combination of signal processing parameters in response to the incoming signal.

42. The apparatus of claim 30, wherein the digital signal processor is configured to decrease the low pass cut off frequency from a maximum bandwidth upper frequency limit, increase the high pass cut off frequency from a maximum bandwidth lower frequency limit, raise the expander threshold, reduce the expander attack time, and reduce the expander release time, as the signal to noise ratio of the incoming signal deteriorates.

43. The apparatus of claim 30, wherein the digital signal processor is configured to mute a detected frequency tone that remains constant for a particular time interval.

44. The apparatus of claim 30, the incoming signal is received from a communications network.

45. The apparatus of claim 44, wherein the communication network is one of: a telephone network, cellular phone network, and voice-over-Internet-Protocol system.

46. An apparatus for enhancing the intelligibility of speech sounds in a communications headset, the apparatus comprising: an input for receiving an incoming signal a digital signal processor configured to detect an incoming signal with speech content and having ambient noise including degrading artifacts, noise, and distortions and adaptively provide a pass band filtering function with a bandwidth pattern narrow at frequencies where ambient noise is to be filtered out so as not to be amplified and information bearing signals are to be amplified and increased in Signal to Noise Ratio, and an expander function to the incoming signal in a sequential manner so that the degraded sound quality of the incoming signal may be modified real-time to increase intelligibility as variations occur in speech sound quality of the incoming signal, the digital signal processor configured to determine a combination of signal processing parameters including a central frequency and a pass band contour, a high pass cutoff frequency value and a low pass cutoff frequency value for the filtering function, and an expander threshold level, an expander attack time, and an expander release time for the expander function, based upon detectable parameters in the incoming signal.

* * * * *